US007523579B2

(12) United States Patent
Al-Mulla

(10) Patent No.: US 7,523,579 B2
(45) Date of Patent: Apr. 28, 2009

(54) LONG GUN STOCK

(76) Inventor: Abdul Qader Al-Mulla, Alrawda, Block 5, St. 57, House 15, Kuwait (KW)

( * ) Notice: Subject to any disclaimer, the term of this patent is extended or adjusted under 35 U.S.C. 154(b) by 137 days.

(21) Appl. No.: 11/349,148

(22) Filed: Feb. 8, 2006

(65) Prior Publication Data

US 2007/0180750 A1 Aug. 9, 2007

(51) Int. Cl.
*F41C 23/06* (2006.01)

(52) U.S. Cl. ..... 42/71.01

(58) Field of Classification Search ..... 42/71.01; D22/103, 108

See application file for complete search history.

(56) References Cited

U.S. PATENT DOCUMENTS

| | | | | | |
|---|---|---|---|---|---|
| 162,373 | A | * | 4/1875 | Freund | 42/71.01 |
| 2,145,078 | A | * | 1/1939 | Ferrel | 42/72 |
| 3,618,584 | A | * | 11/1971 | Pigeon | 124/19 |
| 4,020,740 | A | * | 5/1977 | Schirneker | 89/129.02 |
| D271,607 | S | * | 11/1983 | Aspenwall, John E. | D22/103 |
| 4,503,633 | A | * | 3/1985 | Davis | 42/51 |
| 4,878,305 | A | * | 11/1989 | Gabrielidis | 42/72 |
| D322,115 | S | * | 12/1991 | Custred | D22/103 |
| 5,711,102 | A | * | 1/1998 | Plaster et al. | 42/71.01 |
| D391,334 | S | * | 2/1998 | Plaster et al. | D22/108 |
| 5,970,642 | A | * | 10/1999 | Martin | 42/73 |
| D429,308 | S | * | 8/2000 | Guhring | D22/103 |
| 7,200,966 | B2 | * | 4/2007 | Gooder | 42/71.01 |
| D547,818 | S | * | 7/2007 | Wolfe | D22/103 |
| 2003/0196366 | A1 | * | 10/2003 | Beretta | 42/71.01 |
| 2006/0168868 | A1 | * | 8/2006 | Phillips | 42/71.01 |

* cited by examiner

*Primary Examiner*—Troy Chambers
(74) *Attorney, Agent, or Firm*—Lowe Hauptman Ham & Berner, LLP

(57) ABSTRACT

A long gun stock for a sniper's rifle includes a longitudinally extending support member for supporting a gun barrel and a hollow portion for receiving a firing mechanism. The gun stock also includes front and rear handgrips extending downwardly and rearwardly toward the rear of the gun stock with the front grip curved around and extending into a lower portion of the rear handgrip. The gun stock also includes a rear portion defining a generally V-shaped opening rearwardly of the rear handgrip and is of a one-piece construction.

7 Claims, 2 Drawing Sheets

LONG GUN STOCK

FIELD OF THE INVENTION

This invention relates to a stock for a long gun and more particularly to a stock for supporting a rifle barrel, trigger and firing mechanism for a sniper's rifle.

BACKGROUND FOR THE INVENTION

The prior art discloses various types of rifle stocks to better hold and aim a rifle to reduce recoil and to improve the comfort of a shooter and accuracy of a rifle. Such stocks have been constructed from rigid materials such as wood and plastic. For example, A U.S. Pat. No. 6,301,817 of Hogue et al. entitled "Long Gun Stock," discloses a lightweight gun stock comprising a rigid insert molded of reinforced thermal plastic material with a foaming agent. As disclosed, the insert is over-molded with a thermal plastic material which provides the stock with the desired surface characteristics and is dimensioned with respect to its over-molded surfaces to be smaller than the finished stock. This over-mold material may be a hard un-foamed material or a thermal plastic elastomer and provides the stock with a non-slip surface.

A further development in long gun stocks is disclosed in a U.S. Pat. No. 5,907,918 of Langevin et al. entitled "Rifle Buttstock." The Langevin et al. patent discloses a buttstock formed of a single piece of molded synthetic materials and contains two slots so that the rifle may be carried using a sling in multiple positions. The buttstock is designed to have the same size and occupy the same exterior envelope as an M-16 rifle buttstock but with fewer parts and lower weight without compromising strength. The buttstock comprises a buttplate, a shoulder and a flange all held in spaced relationship with and integral with a panel. Two slots are formed in the panel near the buttstock, one parallel with the shoulder and the other parallel to the flange and each slot is dimensioned to receive a sling.

Another U.S. Pat. No. 5,711,102 of Plaster et al. discloses a user configurable sniper rifle stock. As disclosed therein, the rifle stock comprises a wide forearm and a relatively narrow carry portion extending rearwardly from the forearm. An action mounting portion extends rearwardly from the carry portion and an angled relatively vertical stippled grip extends rearwardly and downwardly from the receiver portion. An open rear stock portion extends rearwardly from the grip and the carry portion and is narrower and thinner than the forearm, while the action mounting, grip and rear portions are generally as wide as the carry portion.

Notwithstanding the above, it is presently believed that there is a long felt need and potential commercial market for improved long gun stocks which are particularly applicable to sniper rifles. For example, it is important for a sniper to shoot and kill from a relatively long distance. It is also frequently necessary for a sniper to carry or hold the rifle for extended periods of time and to make a precision shot at the end of a relatively long period of time. Therefore it is important for accuracy, to reduce the fatigue of a sniper, provide a stable and more comfortable position for shooting and allow a shooter to concentrate more fully on hitting a target. Many of the same needs apply to hunters and other shooters who may travel shorter distances under less grueling circumstances and shoot at nearer targets. However, such casual shooters are probably in poorer physical condition and in need of a more comfortable and a less tiring rifle stock.

Advantageously, gun stocks in accordance with the present invention facilitate making accurate shots from relatively long distances. The long gun stocks as disclosed herein reduce fatigue, provide more comfortable positions for carrying, holding and/or firing a weapon. It is also believed that the long gun stocks disclosed herein will reduce training time and the time for an individual to become familiar with a weapon. In addition, it is now believed that the long gun stocks as disclosed and claimed herein can be manufactured and sold at a competitive price, can be manufactured from wood or plastic, are relatively lightweight, well balanced and durable.

BRIEF SUMMARY OF THE INVENTION

In essence, the present invention contemplates a long gun stock for supporting a rifle barrel, trigger and firing mechanism and which is particularly applicable to a sniper's rifle. The long gun stock includes a support member which extends along a major portion of a rifle barrel for example about 75 percent to about 85 percent of a length of the barrel including its breach. The support member also includes a longitudinally extending barrel receiving surface extending along its length and a hollow section for receiving a trigger and firing mechanism and in one embodiment, a clip for ammunition. In addition, the stock includes a rear handgrip which extends downwardly from the support member behind the trigger and a forward handgrip which extends downwardly from the support member forward of the trigger. In a preferred embodiment of the invention, both handgrips are integral with the support member and are a part of a one-piece construction. The forward grip extends downwardly at an inclined acute angle and is curved around under the trigger and into a lower portion of the rear handgrip to thereby form a relatively large open trigger guard as well as forming a base below the rear handgrip for a shooter's hand. The curved position of the forward handgrip also extends into a rear stock portion which includes an upper and lower surface and a butt portion for engaging a shooter's shoulder. The rear stock portion also defines a relatively large V-shaped opening bounded by the upper surface of the rear stock portion and a rear surface of the rear handgrip.

The invention will now be described in connection with the accompanying drawings wherein like reference numerals have been used to identify like parts.

DESCRIPTION OF THE PREFERRED EMBODIMENTS OF THE INVENTION

Figure 1:
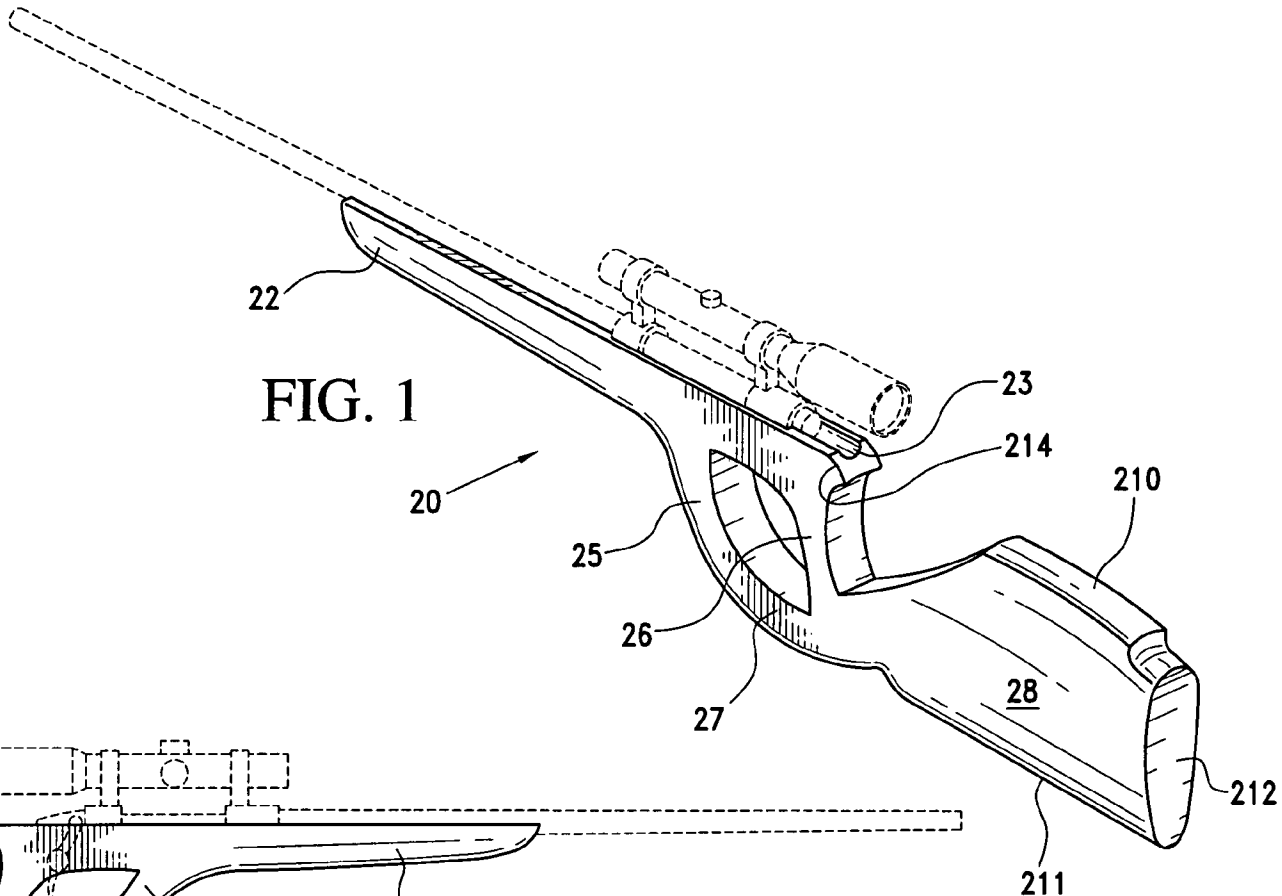
FIG. 1 is a perspective view, which shows a long gun stock in accordance with the present invention with a rifle barrel and telescopic sight in dotted lines.
Figure 2:
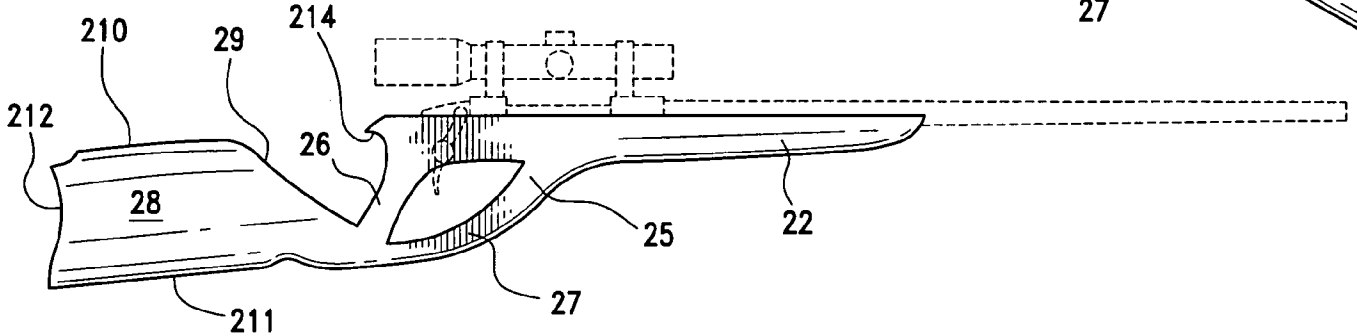
FIG. 2 is a side elevational view of the gun stock as shown in FIG. 1; and, FIG. 3 is a exploded view of the gun stock shown in FIG. 2 but with a barrel firing mechanism and clip separated from the gun stock.

With reference to the accompanying drawings, a preferred embodiment of a long gun stock 20 is illustrated. As shown, the long gun stock 20 for supporting a rifle barrel 30, trigger 31 and firing mechanism 32 including cartridge clip 35 includes a support member 22. The support member 22 extends along a major portion of the rifle barrel 30 including its breach. For example, in a preferred embodiment of the invention, the support member 22 supports about 80 percent of the barrel. The support member 22 also includes a barrel receiving concave surface 23 for cradling the barrel.

Figure 3:
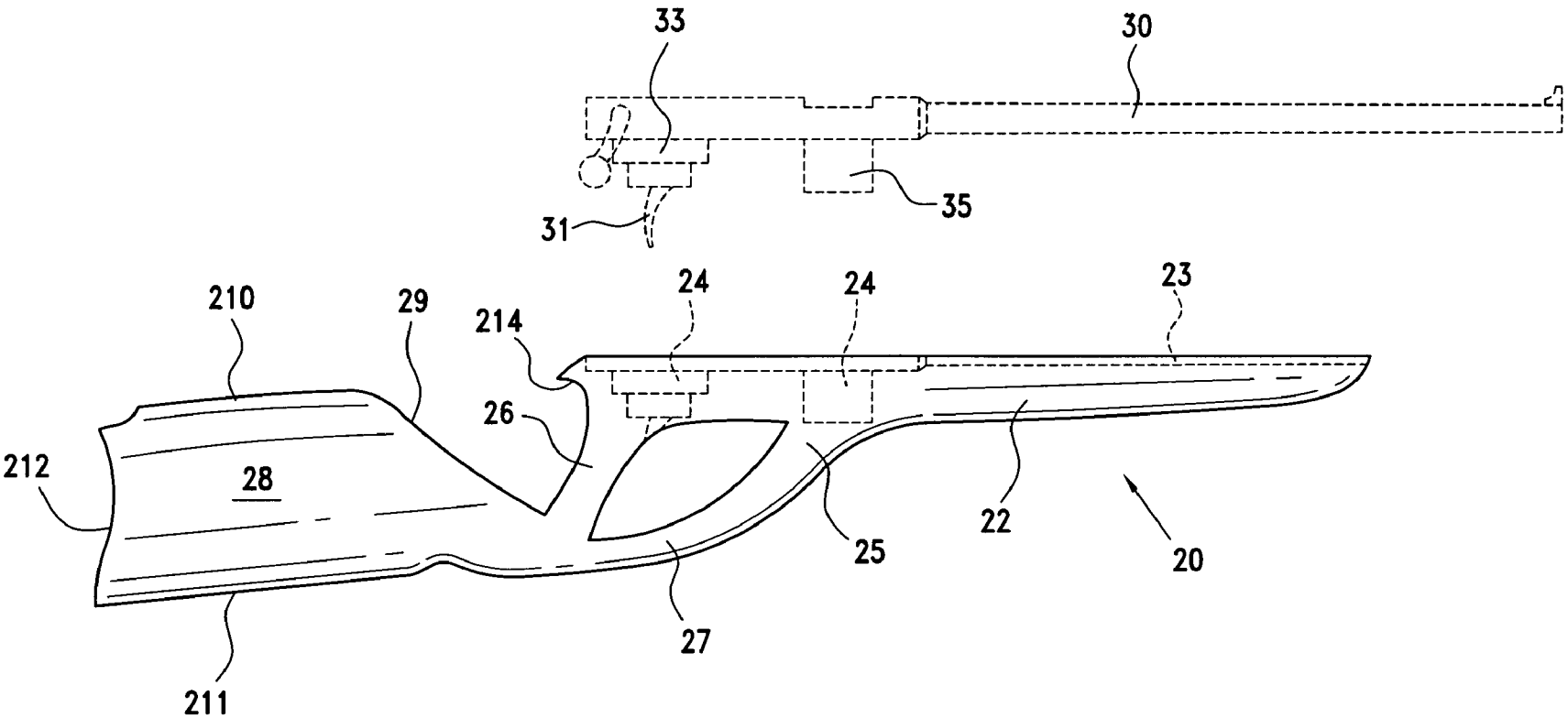

There is a hollowed out portion 24 (FIG. 3) for receiving a trigger 31, trigger assembly or firing mechanism 33 and cartridge clip 35 as shown, the clip 35 fits into a hollowed out portion 24'. An important feature of the present invention resides in a rear handgrip 26 which is positioned behind the trigger 31 and extends downwardly at an angle from the support member 22 at an inclined angle of between about 50 degrees and about 90 degrees preferably at about 60 degrees angled toward the rear of the rifle. The stock 20 also includes a forward arcuate handgrip 25 extending downwardly from the support member 22 forward of the trigger 31. The forward handgrip 25 also includes a lower portion 27 that extends under the trigger 31 and into a lower portion of the rear handgrip 26 to enclose the trigger 31. The forward handgrip 25 is also angled back toward the rear of the gun at an included angle of between about 35 degrees to about 55 degrees and preferably about 45 degrees.

In addition, the stock 20 includes a rear stock portion 28 having upper and lower surfaces 210 and 211 respectively and a butt portion 212 for engaging the shoulder of a shooter. In a preferred embodiment of the invention, the surfaces 210 and 211 are generally parallel and the upper surface 210 forms a cheek rest for the shooter. The rear portion 28 also defines a relatively large V-shaped opening 29 formed adjacent to a rear surface of the rear handgrip 26. The generally V-shaped opening is formed by a cut in the rear portion 28 that extends from the upper surface 210 to a lower portion of the rear handgrip 26 and forms an included angle of about 60 degrees. It should be recognized that the V-shaped opening 29 is of sufficient depth to accommodate the shooter's hand when gripping the rear handgrip. It should be recognized that a U-shaped opening is the equivalent of the V-shaped opening.

A rear projection 214 extends rearwardly from the support member 22 beyond the breach of a barrel of a long gun above the V-shaped opening 29 and is dimensioned to allow room for a shooter's hand to fit comfortably about the rear handgrip 26 without interference therewith. The projection 214 includes an arcuate surface and adds balance to the design. It is contemplated that the long gun stock in accordance with the present invention is of a one-piece construction and made of wood such as teak which is tough, has high shock resistance, and is between light and medium weight. Other woods and plastics may also be used.

While the invention has been defined in accordance with its preferred embodiments, it should be recognized that changes and modifications may be made therein without departing from the scope of the appended claims.

What is claimed is:

1. A long gun stock for supporting a rifle barrel, trigger and firing mechanism in a sniper rifle, said long gun stock comprising:

a support member extending along a major portion of a rifle barrel from behind a trigger and extending forward along the barrel, and said support member including a longitudinally extending barrel receiving surface and a hollow section for receiving a firing mechanism;

a rear handgrip extending downwardly from said support member behind the trigger defining an acute angle of about 60° with said support member and a forward arcuate handgrip extending downwardly from said support member forward of the trigger and curved under the trigger and into said rear handgrip to thereby form an open trigger guard and base below a position for a shooter's hand and in which said forward handgrip defines an included angle of about 45° with said support member;

said open trigger guard defining a sector-like opening bounded by a first essentially horizontal surface leading to a trigger position, a second surface which extends at an obtuse angle with respect to the first surface and which forms a front surface of said rear handgrip, and an arcuate surface interconnecting a leading end of the first surface and the lower end of the front surface of said rear handgrip; and a rear stock portion including upper and lower surfaces and a butt portion for engaging a shooter's shoulder, and said rear stock portion defining a generally V-shaped opening bounded by said upper surface and said rear handgrip.

2. A long gun stock for supporting a rifle barrel, trigger and firing mechanism in a sniper rifle according to claim 1, in which said support member includes a rear projection extending rearwardly and above said rear handgrip.

3. A long gun stock for supporting a rifle barrel, trigger and firing mechanism in a sniper rifle according to claim 2, in which the upper surface of said rear stock portion between said V-shaped opening and said butt portion is generally parallel with a corresponding portion of said lower surface.

4. A long gun stock for supporting a rifle barrel, trigger and firing mechanism in a sniper rifle according to claim 3, in which about 65 percent of the weight of the rifle bears on said forward handgrip and about 35 percent of the weight of the rifle bears on said rear handgrip.

5. A long gun stock for supporting a rifle barrel, trigger and firing mechanism in a sniper rifle according to claim 4, in which said stock is wood and of one-piece construction.

6. A long gun stock for supporting a rifle barrel, trigger and firing mechanism according to claim 4 in which said stock is teak and of one piece construction.

7. A long gun stock for supporting a rifle barrel, trigger and firing mechanism according to claim 4 in which said stock is plastic.

* * * * *